US005238596A

United States Patent [19]

Smith

[11] Patent Number: 5,238,596

[45] Date of Patent: Aug. 24, 1993

[54] DETERGENT FOAM CONTROL AGENTS

[75] Inventor: Graeme S. Smith, Midland, Mich.

[73] Assignee: Dow Corning S.A., Seneffe, Belgium

[21] Appl. No.: 821,658

[22] Filed: Jan. 16, 1992

[30] Foreign Application Priority Data

Jan. 24, 1991 [GB] United Kingdom ..... 9101606

[51] Int. Cl.[5] ..... C11D 3/00

[52] U.S. Cl. ..... 252/174.150; 252/174.17; 252/174.23; 252/DIG. 2; 252/358

[58] Field of Search ..... 252/174.15, 174.17, 252/174.23, DIG. 2, 358; 106/287.16

[56] References Cited

U.S. PATENT DOCUMENTS

| | | | |
|---|---|---|---|
| 3,933,672 | 1/1976 | Bartolotta | 252/116 |
| 4,447,349 | 5/1984 | Tai | 252/174.13 |
| 4,451,387 | 5/1984 | Tai | 252/174.15 |
| 4,690,713 | 9/1987 | Terae et al. | 106/287.12 |
| 4,806,266 | 2/1989 | Burrill | 252/174.15 |
| 4,818,292 | 4/1989 | Iley et al. | 252/358 |

FOREIGN PATENT DOCUMENTS

| | | | |
|---|---|---|---|
| 210731 | 2/1987 | European Pat. Off. . | |
| 414221 | 2/1991 | European Pat. Off. . | |
| 0414221 | 2/1991 | European Pat. Off. | 252/174.15 |
| 1492939 | 11/1977 | United Kingdom . | |

*Primary Examiner*—Olik Chaudhuri
*Assistant Examiner*—C. Everhart
*Attorney, Agent, or Firm*—Timothy J. Troy

[57] ABSTRACT

Particulate foam control agents for powder detergents consist of 1 part by weight of silicone antifoam, not less than 0.3 part by weight of a water insoluble fatty acid or a fatty alcohol with 12 to 20 carbon atoms and a melting point in the range 45 to 80% or a monoester of glycerol and a fatty acid and a native starch carrier material. They give improved storage stability and require less organic material than the prior art agents.

19 Claims, No Drawings

DETERGENT FOAM CONTROL AGENTS

This invention is concerned with foam control agents and with detergent compositions comprising these foam control agents.

Detergent compositions in powder form are used for washing purposes in machines for washing dishes or for laundering of textiles. These compositions generally contain organic surfactants, builders, for example phosphates, bleaching agents and various organic and inorganic additives. The surfactants usually employed in domestic textile washing powders when agitated in an aqueous medium during a washing cycle tend to yield copious quantities of foam. However, presence of excessive amounts of foam during a washing cycle in certain washing machines tends to adversely affect the quality of the washing process.

It has become a practice to include in detergent compositions materials which are intended to control the amount of foam produced during a washing cycle. Various materials have been proposed for this purpose, including certain silicone foam control agents. Silicone foam control agents, especially those based on polydimethylsiloxanes, have been found to be particularly useful foam control agents in a variety of media. However, generally silicone foam control agents, when incorporated in detergent compositions in powder form, appear to lose their effectiveness after prolonged storage in the detergent compositions.

E.P. Patent Specification 210 721 is directed to a silicone foam control agent which is stable on storage. It provides a particulate foam control agent in finely divided form for inclusion in a detergent composition in powder form, the agent comprising 1 part by weight of silicone antifoam and not less than 1 part by weight of an organic material characterised in that the organic material is a fatty acid or a fatty alcohol having a carbon chain containing from 12 to 20 carbon atoms, or which is a mixture of two or more of these, said organic material having a melting point in the range 45° to 80° C. and being insoluble in water, and in that the foam control agent is produced by a process in which the silicone antifoam and the organic material are contacted in their liquid phase. According to the specification it is preferable that the ratio of organic material to silicone antifoam is kept at 3:1 or above, to ensure free-flowing characteristics of the agent to ease the distribution of the foam control agent in the detergent powder. The most preferred ratio of organic material to silicone antifoam is stated to be from 3:1 to 4:1.

E.P. Specification 210 731 provides a particulate foam control agent in finely divided form for inclusion in a detergent composition in powder form, characterised in that the agent is wax-free and comprises a silicone antifoam and organic material having a melting point in the range 50° to 85° C. and comprising a monoester of glycerol and a fatty acid having a carbon chain containing from 12 to 20 carbon atoms. Preferably the ratio of organic material to silicone antifoam is stated to be from 2:1 to 2.5:1. Ratios below 1:1 are said to possibly give both manufacturing problems and storage stability problems, while ratios above 5:1 are stated not to contribute any extra benefit.

Both specification E.P. 210 721 and E.P. 210 731 state that carrier particles may be included in the foam control agents, which provide a solid basis on which the silicone antifoam and the organic material may be deposited during manufacture. This allows easy mixing in a powder detergent, bulking up the foam control agent to facilitate the dispersibility in the powder detergent. It is stated that the carrier particles are preferably water soluble solid powders, although the examples given include zeolites and clay minerals as well as sodium sulphate, sodium carbonate, carboxymethyl cellulose and most preferably sodium tripolyphosphate particles.

The foam control agents described in E.P. 210 721 and E.P. 210 731 perform quite adequately in many situations, but there is a continuous search for foam control agents which are even more storage stable. There is also a desire to limit the amount of organic material, which in itself does not perform a useful function in the laundering process. We have now found that by using native starch carriers instead of the suggested and preferred carrier materials, improved foam control agents can be produced.

Starch has been suggested in certain compositions as absorbent materials for silicone antifoams. G.B. Patent Specification 1 492 939 discloses granular built detergent compositions which comprise surfactants, detergency building salts, substantially water-insoluble micro-crystalline waxes and a suds-depressing amount of a stable silicone suds-controlling agent, releasable incorporated in a water soluble or water-dispersible, substantially nonsurface-active detergent impermeable envelope. It is suggested in the patent specification, as in the specification G.B. 1 407 997, to spray-dry the melt containing the silicone suds-controlling agent and the envelope material onto a fluidised bed of dry powders, e.g. sodium tripolyphosphate, sodium carbonate, sodium carboxymethylcellulose, granulated starch, clay, sodium citrate, sodium acetate, sodium sulphate and the like, before mixing it into the detergent composition. Nothing in either specification suggests that satisfactory results for the storage stability of silicone based foam control agents could be obtained by spraying a melt including different organic materials, e.g. certain fatty acids, fatty alcohols or monoesters of glycerol and fatty acids, onto any of these carriers. Neither of the specifications suggests that any improvement would be obtained by selecting to use native starch as a carrier material instead of any of the alternative dry powders mentioned as potential carriers.

Although the specification of G.B. 1 492 939 states that the amount of envelope material used to isolate the suds-controlling agent from the detergent component is not critical, as long as enough is used to provide sufficient volume that substantially all the silicone can be incorporated therein and preferably sufficient to provide for sufficient strength of the resultant granules to resist premature breaking, examples use a high ratio of envelope material over suds-controlling agent, i.e. a ratio of 40 parts of the envelope material to 5 parts of the silicone suds-controlling agent. There is a need to provide a system in which less envelope material is required.

E.P. 040 091 describes suds-suppressing granules which comprise a substantially spherical or cylindrical core material, and one or more coatings comprising a mixture of silicone oil and hydrophobic particles. It is claimed that such granules are less quickly deactivated than those granules in which irregularly shaped substances such as granular tripolyphosphate are used as solid core materials for impregnating with silicone antifoams. Suitable core materials mentioned include sucrose, spherical enzyme-containing prills and substantially cylindrical enzyme-containing marumes and Alcalase T granules. The specification further mentions that it is preferred to produce a granule which has a core coated with a particulate absorbent, which is impregnated with the silicone oil mixture. The resultant particle is further coated with a protective envelope. Starch and titanium dioxide are stated to be the preferred absorbents. There is a need to provide improved foam controlling agents which use a smaller number of materials and which are not dependant on the geometric shape of the core material.

E.P. 071 481 describes a detergent composition comprising an anionic surfactant and a suds-controlling agent characterised in that the suds-controlling agent comprises a core of gelatinised starch having a mixture of silicone oil and hydrophobic silica absorbed thereon. The specification also states that preferably the suds-control agent is coated with a layer of wax, preferably paraffin wax, in order to improve their storage characteristics. Producing a gelatinised starch derivative requires extra processing steps. There is a desire to be able to use materials which are more commonly available and are less expensive.

E.P. 414 221, which was published after the priority date of the present invention, discloses an anti-foaming agent granular product which comprises a silicone antifoaming agent, a water soluble starch or a modified or derived product thereof, an inorganic builder or clay mineral and an organic binder. Water soluble starch is said to be useful for washing conditions in Japan where lower temperatures are used. Rendering starch water soluble requires some modification of natural starch which is not water-soluble.

We have now found that combining a silicone antifoam with native starch as a carrier material in combination with certain organic materials provides an improved foam control agent.

According to one aspect of the invention there is provided a particulate foam control agent in finely divided form for inclusion in a detergent composition in powder form, the agent consisting essentially of A. 1 part by weight of silicone antifoam, B. not less than 0.3 part by weight of an organic material, said organic material being either (1) a fatty acid or a fatty alcohol having a chain containing from 12 to 20 carbon atoms, or a mixture of two or more of these, said organic material having a melting point in the range 45° to 80° C. and being insoluble in water, or (2) an organic material having a melting point in the range 50° to 85° C. and comprising a monoester of glycerol and a fatty acid having a carbon chain containing from 12 to 20 carbon atoms, and C. a carrier material onto which the silicone antifoam and the organic material are deposited, characterised in that the carrier material is native starch.

A suitable silicone antifoam (A) for use in the foam control agents according to the invention is an antifoam compound comprising a polydiorganosiloxane and a solid silica. Such antifoam compounds are well known in the art and have been described in numerous patent applications. A suitable polydiorganosiloxane is a substantially linear polymer of the average formula

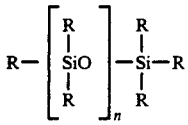

where each R independently can be an alkyl or an aryl radical. Examples of such substituents are methyl, ethyl, propyl, isobutyl and phenyl. A small amount of branching in the chain is possible and small amounts of silicon-bonded hydroxyl groups may also be present. Preferred polydiorganosiloxanes are polydimethylsiloxanes having trimethylsilyl end-blocking units and having a viscosity at 25° C. of from $5.10^{-5}$ $m^2/s$ to 0.1 $m^2/s$ i.e. a value of n in the range 40 to 1500. These are preferred because of their ready availability and their relatively low cost. The solid silica of the silicone antifoam can be a fumed silica, a precipitated silica or a silica made by the gel formation technique. The silica particles preferably have an average particle size of from 0.1 to 50$\mu$, preferably from 1 to 20$\mu$ and a surface area of at least 50 $m^2/g$. These silica particles can be rendered hydrophobic e.g. by treating them with dialkylsilyl groups and/or trialkylsilyl groups either bonded directly onto the silica or by means of a silicone resin. We prefer to employ a silica, the particles of which have been rendered hydrophobic, with dimethyl and/or trimethyl silyl groups. Silicone antifoams employed in a foam control agent according to the invention suitably have an amount of silica in the range of 1 to 30% (more preferably 2.0 to 15%) by weight of the total weight of the silicone antifoam resulting in silicone antifoams having an average viscosity in the range of from $2\times10^{-4}$ $m^2/s$ to 1 $m^2/s$. Preferred silicone antifoams may have a viscosity in the range of from $5\times10^{-3}$ $m^2/s$ to 0.1 $m^2/s$. Particularly suitable are silicone antifoams with a viscosity of $2\times10^{-2}$ $m^2/s$ or $5\times10^{-2}$ $m^2/s$.

The organic material (B) for use in the foam control agents according to the invention has a melting point in the range from 45° to 80° C. in the case of Organic material (1) or from 50° to 85° C. in the case of Organic material (2). The organic material may comprise a single compound which has a melting point in either temperature range or a mixture of compounds which has a melting point in the relevant range.

Organic materials suitable for use in a foam control agent according to the invention are water insoluble fatty acids, fatty alcohols and mixtures thereof or monoesters of glycerol and certain fatty acids. Examples include stearic acid, palmitic acid, myristic acid, arichidic acid, stearyl alcohol, palmityl alcohol, lauryl alcohol, monoesters of glycerol and aliphatic fatty acids having a carbon chain containing 12 to 20 carbon atoms, glyceryl monolaurate, glyceryl monomyristate, glyceryl monopalmitate and glyceryl monostearate.

Preferably a foam control agent according to the invention comprises an organic material which is stearic acid, stearyl alcohol or glyceryl monostearate. Stearic acid and stearyl alcohol are preferred because of their good performance, easy availability and suitable melting point. The melting points of stearic acid and stearyl alcohol are 71.5° and 59.4° C. respectively at which temperatures they are insoluble in water. Glyceryl monostearate is preferred because of its good performance, easy availability, degree of water dispersibility and suitable melting point. Glyceryl monostearate having in its pure form a melting point of 82° C. (α-ester) or 74° C. (β-ester), is commercially available in different grades which are believed to comprise mixtures of the monoester, diester and triester alongside some free glycerol and free stearic acid.

Glyceryl monostearate is available as a non-emulsifying or a self-emulsifying material. The self-emulsifying glyceryl monostearate comprises also a certain amount of soap and is particularly preferred. This material is believed to comprise about 30% by weight of the glyceryl monostearate and about 5% by weight of a soap as well as mixtures of diesters and triesters and has a melting point of about about 58° C. Glyceryl monostearate (self emulsifying) is water dispersible at its melting point of 58° C. In the case of using Organic material (2) it is preferred that the foam control agent should be wax-free, i.e. does not contain any monoesters of long chain unbranched fatty acids ($C_{24}$ to $C_{36}$) and alcohols ($C_{16}$ to $C_{36}$) Most preferred, however, is the use of stearyl alcohol as the organic material.

The lower melting point of 45° or 50° C. is chosen in order that the foam control agent may be stable under routine conditions of storage and transportation of a detergent composition containing it. During summer months, or in warmer countries, during transport or storage the ambient temperature can rise to 40° C. or more. Also, many housewives store the container of the detergent composition in a room where heat is generated and temperatures could be in excess of 40° C. The upper melting point of 80° or 85° C. is selected in order to ensure that the silicone antifoam which is bound by the organic material is released at a useful stage in the washing cycle in order to control foaming. Foam control agents, according to the invention, for use in detergent compositions in powder form intended for use in laundering operations at lower temperatures, for example 60° C., preferably employ organic materials having a melting point in the range 50° to 60° C.

Component (C) for use in foam control agents according to the invention is native starch. Starch is a polysaccharide which serves in plants as a storage compound, e.g. in seeds, fruits and tubers and comprises amylose and amylopectin. With the expression native starch is meant starch as extracted from its natural source, without undergoing any artificial process which would alter its chemical or structural nature. This distinguishes native starch from gelatinised starch. Suitable sources of native starch include potato, rice, corn, maize and wheat. The average diameter of native starch tends to vary according to the source. Native starch is a commercially available product which may be bought for example from National Starch Limited in the U.K.

The amount of organic material employed in a foam control agent according to the invention, is from 0.3 part by weight organic material per part of silicone antifoam in order to minimise difficulties of manufacture of the foam control agent. The amount of organic material is chosen so that when the foam control agent has been added to a detergent composition the composition remains stable upon storage. It is, however, desirable to keep the amount of organic material to a minimum because it is not expected directly to contribute significantly to the cleaning performance of the detergent composition. The organic material is preferably removed from the laundered materials, for example with the washing liquor, so as to avoid unacceptable soiling or greying of the laundered materials. The weight to weight ratio of organic material to silicone antifoam in a foam control agent, according to the invention, may suitably be less than 10:1. Foam control agents which employ ratios above 10:1 are effective but it does not seem necessary to employ ratios in excess of 10:1. We prefer to employ the organic material and the silicone antifoam in a weight ratio in the range 5:1 to 0.5:1, more preferably in the range 0.7:1 to 1.5:1. Ratios below 0.3:1 may give both manufacturing problems and storage stability problems.

The amount of starch which may be used is not critical but it is preferred that a foam control agent, according to the invention, comprises from 40 to 90% by weight of native starch based on the total weight of the foam control agent. More preferably the starch particles make up 60 to 80% by weight of the total foam control agent.

The organic material is selected for its ability to preserve sufficient of the activity of the silicone antifoam during storage and until required to perform its antifoam function during the wash cycle. None of the preferred organic materials appear to interfere with the effectiveness of the silicone antifoam when it is released into the washing liquor.

The starch particles provide a carrier for the foam control agent which is more effective than the standard carrier materials, such as sodium tripolyphosphate, as it tends to bind the silicone antifoam (A) and the organic material (B) more effectively in the powder detergent composition.

Although it is preferred that the foam control agent according to the invention consists essentially of, more preferably exclusively of, Components (A), (B) and (C) small amounts of other materials may also be present. These other materials should not comprise more than 10% by weight of the total weight of the foam control agent, preferably not more than 5% by weight. Potential additional materials include alternative carrier materials e.g. Sodium Tri Polyphosphate, zeolites, carbonates, clays, dispersion aids, waxes, non-silicone antifoams, diluents, anti-redepositioning agents and the like.

Foam control agents according to the invention may be made by any convenient method. Preferably the silicone antifoam and the organic material are contacted in their liquid phase and a mixture of the antifoam and the organic material are deposited onto native starch. The conventional procedures for making powders are particularly convenient e.g. granulation and fluid bed coating procedures. For example the organic material in liquid form, and the silicone antifoam in liquid form, may be passed into a tower and permitted to form the foam control agent by depositing native starch onto a mixture of the antifoam and the organic material. In one method the silicone antifoam and the organic material are sprayed simultaneously onto a fluidised bed. Upon spraying small liquid droplets are formed containing the silicone antifoam and the organic material. The droplets cool down as they make their way onto the bed. Thus they solidify, forming a particulate finely divided foam control agent which is then deposited onto native starch. The silicone antifoam and the organic material may be mixed prior to spraying, or by contacting the sprayed liquid droplets of both materials, for example by spraying the materials via separate nozzles. Solidification of the droplets may be encouraged, for example by use of a cool air counter stream, thus reducing more quickly the temperature of the droplets. Preferably the solidification does not take place prior to the mixture being deposited onto the native starch. The finely divided foam control agent is then collected at the bottom of the tower. In another method the silicone antifoam and organic material are sprayed simultaneously into a drum mixer containing native starch. On spraying small liquid droplets are formed containing the silicone antifoam and the organic material. The droplets partially cool down on contact with the native starch particles. After mixing is complete the partially cooled particles are transferred to a fluidised bed where cooling is completed with ambient air. The finely divided particles of foam-control agent are then collected directly from the fluidised bed. Optionally the particles may be further screened by sieving to produce particles of foam-control agent substantially free of any undersized (e.g. <0.125 mm) or oversized (e.g. >1.4 mm) material. A typical apparatus which is useful for the method of the invention is the Eirich® pan granulator, the Schugi® mixer, the Paterson-Kelly® twin-cone blender, the Lödige® ploughshare mixer or one of the numerous fluidised bed apparatuses, e.g. Aeromatic® fluidised bed granulator.

According to another aspect of the invention there is provided a method of making a particulate foam control agent in finely divided form for inclusion in a detergent composition in powder form, characterised in that 1 part by weight of silicone antifoam and not less than 0.3 part by weight, preferably 0.5 part by weight, of an organic material which is either (1) a fatty acid or a fatty alcohol having a carbon chain containing from 12 to 20 carbon atoms, said organic material having a melting point in the range 45° to 80° C. and being insoluble in water, or a mixture of two or more of these, or (2) an organic material having a melting point in the range 50° to 85° C. and comprising a monoester of glycerol and a fatty acid having a carbon chain containing from 12 to 20 carbon atoms, are contacted together in their liquid phase and are caused to be deposited onto native starch in admixture.

In a preferred method according to the invention the silicone antifoam and the organic material may be mixed and heated to a temperature above the melting point of the organic material. They may be heated to such temperature before, during or after the mixing stage. The temperature is chosen sufficiently high, for example 80° C., so that the transport from the mixing and/or heating vessel to a spray unit does not cause this temperature to fall below the melting point of the organic material. Any conventional mixing method may be used for the mixing of the silicone antifoam and the organic material for example paddle stirring or ribbon blending. The heated mixture may then be transferred under pressure to a spray nozzle. This can be achieved by any conventional pumping system, but preferably a peristaltic pump is used as this avoids any possible contamination of the mixture with materials from the pump. The pumping rate may vary and can be adapted to the type of spray unit used. The mixture may suitably be pumped at a rate of for example 1.4 $10^{-6}$ $m^2/s$. The spray nozzle and spraying pressure are chosen such that the liquid droplets which are formed are small enough to enable even distribution onto a fluid bed of native starch. A foam control agent according to the invention is then collected.

The present invention also provides in another of its aspects a detergent composition in powder form, comprising a detergent component and a foam control agent according to the invention. The foam control agent according to the invention may be added to the detergent component in a proportion of from 0.1 to 25% by weight based on the total detergent composition. Preferably foam control agents are added in a proportion of from 0.25 to 5% by weight based on the total detergent composition.

Suitable detergent components comprise an active detergent, organic and inorganic builder salts and other additives and diluents. The active detergent may comprise organic detergent surfactants of the anionic, cationic, non-ionic or amphoteric type, or mixtures thereof. Suitable anionic organic detergent surfactants include alkali metal soaps of higher fatty acids, alkyl aryl sulphonates, for example sodium dodecyl benzene sulphonate, long chain (fatty) alcohol sulphates, olefine sulphates and sulphonates, sulphated monoglycerides, sulphated ethers, sulphosuccinates, alkane sulphonates, phosphate esters, alkyl isothionates, sucrose esters and fluoro-surfactants. Suitable cationic organic detergent surfactants include alkyl-amine salts, quaternary ammonium salts, sulphonium salts and phosphonium salts.

Suitable non-ionic organic surfactants include condensates of ethylene oxide with a long chain (fatty) alcohol or fatty acid, for example $C_{14-15}$ alcohol, condensed with 7 moles of ethylene oxide (Dobanol 45-7), condensates of ethylene oxide with an amine or an amide, condensation products of ethylene and propylene oxides, fatty acid alkylol amides and fatty amine oxides. Suitable amphoteric organic detergent surfactants include imidazoline compounds, alkylaminoacid salts and betaines. Examples of inorganic components are phosphates and polyphosphates, silicates, such as sodium silicates, carbonates, sulphates, oxygen releasing compounds, such as sodium perborate and other bleaching agents and zeolites. Examples of organic components are anti-redeposition agents such as carboxy methyl cellulose (CMC), brighteners, chelating agents, such as ethylene diamine tetra-acetic acid (EDTA) and nitrilotriacetic acid (NTA), enzymes and bacteriostats. Materials suitable for the detergent component are well known to the person skilled in the art and are described in many text books, for example Synthetic Detergents, A. Davidsohn and B. M. Milwidsky, 6th edition, George Godwin (1978).

Foam control agents according to the invention do not appear to give rise to deposits of the organic material upon textiles laundered with detergent compositions containing these foam control agents in amounts sufficient to control the foam level during laundering operations. An additional advantage of the preferred foam control agents according to the invention is that the amount of organic material introduced into a detergent composition is lower than the amount used in the prior art. However, the most attractive advantage lies in the fact that the the storage stability in detergent compositions in powder form of foam control agents according to the present invention is greater than with the prior art.

There now follows an example of a foam control agent according to the invention, a process for making it and a detergent composition comprising it. All parts and percentages are expressed by weight unless otherwise stated.

EXAMPLE 1

I. Method of making foam control agent

A foam control agent according to the invention was prepared by stirring 100 g of a silicone antifoam into 150 g of molten stearyl alcohol (Henkel Chemicals Limited). The mixture thus formed was heated to 75° C. This hot liquid mixture was then pumped with a peristaltic pump, via a heat-traced transport line, to the spray head of a fluid bed Aeromatic® coating equipment. There it was sprayed at a pressure of $1.2\times10^5$ Pa through a nozzle of 1.1 mm diameter at a rate of $1.42\times10^{-6}$ $m^3/s$ onto a fluid bed of 375 g of native potato starch, obtained from National Starch Limited. The starch was kept in a fluid bed by an air pressure at a relative setting of 8 to 10. When all the mixture was sprayed onto the starch a particulate foam control agent according to the invention was collected.

II. Foam control agent

An illustrative example foam control agent was made according to the illustrative method. The silicone antifoam consisted of a mixture of polydimethylsiloxanes and about 5% by weight of the antifoam of hydrophobic silica. The antifoam has a viscosity at 25° C. of $3\times10^{-2}$ $m^2/s$.

Two comparative example foam control agents were made. Comparative example 1 used sodium tripolyphosphate (Granular Empiphos®, Albright & Wilson) instead of native starch and comparative example 2 used carboxymethyl cellulose (Tylose® CR1500W, Hoechst).

III. Storage stability testing

A detergent composition was prepared by mixing 9 parts sodium dodecyl benzene sulphonate, 4 parts Dobanol 45-7 (linear primary alcohol ethoxylate $C_{14-15}$ 7EO), 30 parts sodium tripoly-phosphate and 25 parts sodium perborate. This composition is regarded as a basis for a detergent powder composition which may be made up to 100 parts with other ingredients, for example diluents, builders and additives; as these ingredients do not usually tend to contribute significantly to the foam generation of the composition they are not included in the detergent test composition.

The detergent test composition was divided into 9 lots of 68 g, to three lots of which the illustrative foam control agent and the comparative foam control agents were then respectively added, and mixed in in proportions sufficient to give, based on the weight of the detergent test composition, 0.12% of silicone antifoam.

A conventional automatic washing machine (Miele 427) of the front loading type having a transparent door through which clothes may be loaded to a rotation drum of the machine, was loaded with 3.5 kg of clean cotton fabric. A wash cycle with a main wash (95° C.) was carried out using one portion of sample detergent for each of the prewash and the main wash, each portion containing 68 g of the detergent test composition. The door of the washing machine was divided in its height by a scale from 0 to 100% with 10% intervals. The level of the top of the foam during the wash cycle was compared with the scale every five minutes of the main wash, when the rotation drum of the washing machine was stationary and the scale values were recorded.

A first set of sample detergents, consisting of one illustrative sample and 2 comparative samples, was tested immediately after admixture of the foam control agent or of the silicone antifoam (initial test). A second set was stored in closed glass containers at 40° C. for 14 days before testing (test I after storage). A third set was stored in closed glass containers at 40° C. for 28 days before testing (test II after storage). The results are recorded in Tables I to III.

TABLE I

| Initial Test - Foam Height Recorded (%) | | | |
|---|---|---|---|
| Time (Minutes) | Comparative Sample 1 | Comparative Sample 2 | Illustrative Sample |
| 5 | 0 | 0 | 0 |
| 10 | 0 | 0 | 0 |
| 15 | 0 | 0 | 0 |
| 20 | 0 | 0 | 0 |
| 25 | 0 | 0 | 0 |
| 30 | 0 | 0 | 0 |
| 35 | 10 | 10 | 0 |
| 40 | 10 | 20 | 10 |
| 45 | 30 | 30 | 25 |
| 50 | 40 | 30 | 30 |
| 55 | 45 | 45 | 35 |
| 60 | 50 | 55 | 50 |

TABLE II

| Storage Test I - Foam Height Recorded (%) | | | |
|---|---|---|---|
| Time (Minutes) | Comparative Sample 1 | Comparative Sample 2 | Illustrative Sample |
| 5 | 0 | 0 | 0 |
| 10 | 0 | 0 | 0 |
| 15 | 0 | 10 | 0 |
| 20 | 10 | 20 | 0 |
| 25 | 40 | 40 | 0 |
| 30 | 50 | 50 | 10 |
| 35 | 70 | 50 | 10 |
| 40 | 75 | 60 | 20 |
| 45 | 90 | 80 | 20 |
| 50 | Overflow | Overflow | 35 |
| 55 | Overflow | Overflow | 50 |
| 60 | Overflow | Overflow | 60 |

TABLE III

| Storage Test II - Foam Height Recorded (%) | | | |
|---|---|---|---|
| Time (Minutes) | Comparative Sample 1 | Comparative Sample 2 | Illustrative Sample |
| 5 | 0 | 0 | 0 |
| 10 | 0 | 15 | 0 |
| 15 | 10 | 20 | 0 |
| 20 | 30 | 30 | 0 |
| 25 | 60 | 50 | 10 |
| 30 | 70 | 80 | 20 |
| 35 | Overflow | 90 | 25 |
| 40 | Overflow | Overflow | 30 |
| 45 | Overflow | Overflow | 30 |
| 50 | Overflow | Overflow | 45 |
| 55 | Overflow | Overflow | 60 |
| 60 | Overflow | Overflow | 75 |

By overflow we mean that the foam came out of the washing machine through a vent at the top.

As can be seen from the results shown in the Tables the sample detergent compositions containing a foam control agent according to the invention retain their foam control ability after prolonged storage, whereas the prior art materials are not sufficiently effective.

EXAMPLE 2

A series of foam control agents were prepared according to the method disclosed in Example 1 apart from the fact that only 50 g of the silicone antifoam was used and 100 g, 75 g, 50 g, 37.51 g, 25 g and 15 g of molten stearyl alcohol were used respectively for foam control agents (a), (b), (c), (d), (e) and (f). The amount of native starch used was sufficient to make a total of 500 g foam control agent in each case. The foam control agent granules were added to a detergent test composition as described in Example 1 giving an addition level of 0.15% silicone antifoam by weight of the total detergent composition. Storage stability was tested by storing detergent samples at 40° C. for 7 days (storage test I) and 14 days (storage test II) respectively, and comparing the foam controlling performance with fresh detergent samples (initial test). The foam height was measured in the washing machine described in Example 1 after 55 minutes of a boil cycle. The results are given in the Table below where (a), (b), (c), (d), (e) and (f) refer to the results for the detergent compositions containing the respective foam control agents.

TABLE IV

| | FOAM HEIGHT RECORDED (%) | | |
|---|---|---|---|
| Sample | Initial test | Storage I | Storage II |
| (a) | 50 | 50 | 50 |
| (b) | 50 | 50 | 50 |
| (c) | 50 | 50 | 50 |
| (d) | 50 | 50 | 50 |
| (e) | 50 | 50 | 75 |
| (f) | 50 | 75 | 75 |

It can be seen that even at low ratios of organic material to silicone antifoam an acceptable storage stability is still obtained.

That which is claimed is:

1. A particulate foam control agent in finely divided form for inclusion in a detergent composition in powder form, the agent consisting essentially of A. 1 part by weight of silicone antifoam, B. not less than 0.3 part by weight of an organic material, said organic material being selected from (1) at least one fatty acid having a carbon chain containing from 12 to 20 carbon atoms, said organic material having a melting point in the range 45° to 80° C. and being insoluble in water (2) at least one fatty alcohol, having a carbon chain containing from 12 to 20 carbon atoms, said organic material having a melting point in the range 45° to 80° C. and being insoluble in water (3) a mixture of at least one fatty acid and one fatty alcohol, each having a carbon chain containing from 12 to 20 carbon atoms, said organic material having a melting point in the range 45° to 80° C. and being insoluble in water, (4) an organic material having a melting point in the range 50° to 85° C. and comprising a monoester of glycerol and a fatty acid having a carbon chain containing from 12 to 20 carbon atoms, and C. a native starch carrier material onto which the silicone antifoam and the organic material are deposited.

2. A particulate foam control agent according to claim 1 wherein silicone antifoam (A) comprises a polydimethylsiloxane having trimethylsilyl end-blocking units and having a viscosity at 25° C. of from $5\times10^{-5}$ $m^2/s$ to 0.1 $m^2/s$.

3. A particulate foam control agent according to claim 1 wherein the silicone antifoam (A) comprises a silica with an average particle size of from 1 to 20μ, a surface area of at least 50 $m^2/g$, and whereof the surface has been rendered hydrophobic.

4. A particulate foam control agent according to claim 2 wherein the silicone antifoam (A) comprises a silica with an average particle size of from 1 to 20μ, a surface area of at least 50 $m^2/g$, and whereof the surface has been rendered hydrophobic.

5. A particulate foam control agent according to claim 1 wherein the organic material (B) is selected from materials which comprise stearic acid, materials which comprise stearyl alcohol and materials which comprise glyceryl monostearate.

6. A particulate foam control agent according to claim 1 wherein the weight ratio of organic material (B) to silicone antifoam (A) is in the range 0.7:1 to 1.5:1.

7. A particulate foam control agent according to claim 5 wherein the weight ratio of organic material (B) to silicone antifoam (A) is in the range 0.7:1 to 1.5:1.

8. A particulate foam control agent according to claim 1 wherein the amount of native starch used makes up from 40 to 90% by weight of the total foam control agent.

9. A particulate foam control agent according to claim 5 wherein the amount of native starch used makes up from 40 to 90% by weight of the total foam control agent.

10. A particulate foam control agent according to claim 6 wherein the amount of native starch used makes up from 40 to 90% by weight of the total foam control agent.

11. A particulate foam control agent according to claim 1 wherein the amount of native starch used makes up from 60 to 80% by weight of the total foam control agent.

12. A particulate foam control agent according to claim 5 wherein the amount of native starch used makes up from 60 to 80% by weight of the total foam control agent.

13. A particulate foam control agent according to claim 6 wherein the amount of native starch used makes up from 60 to 80% by weight of the total foam control agent.

14. A method of making a particulate foam control agent in finely divided form for inclusion in a detergent composition in powder form characterised in that 1 part by weight of silicone antifoam and not less than 0.3 part by weight of an organic material which is selected from (1) at least one fatty acid having a carbon chain containing from 12 to 20 carbon atoms, said organic material having a melting point in the range 45° to 80° C. and being insoluble in water (2) at least one fatty alcohol, having a carbon chain containing from 12 to 20 carbon atoms, said organic material having a melting point in the range 45° to 80° C. and being insoluble in water (3) a mixture of at least one fatty acid and one fatty alcohol, each having a carbon chain containing from 12 to 20 carbon atoms, said organic material having a melting point in the range 45° to 80° C. and being insoluble in water, (4) an organic material having a melting point in the range 50° to 85° C. and comprising a monoester of glycerol and a fatty acid having a carbon chain containing from 12 to 20 carbon atoms, are contacted together in their liquid phase and are caused to be deposited onto native starch in admixture.

15. In a powder detergent composition comprising a detergent component and a particulate foam control agent, the improvement comprising using as the particulate foam control agent the composition of claim 1.

16. In a powder detergent composition comprising a detergent component and a particulate foam control agent, the improvement comprising using as the particulate foam control agent the composition of claim 5.

17. In a powder detergent composition comprising a detergent component and a particulate foam control agent, the improvement comprising using as the particulate foam control agent the composition of claim 6.

18. In a powder detergent composition comprising a detergent component and a particulate foam control agent, the improvement comprising using as the particulate foam control agent the composition of claim 8.

19. In a powder detergent composition comprising a detergent component and a particulate foam control agent, the improvement comprising using as the particulate foam control agent the composition of claim 11.

* * * * *